US010612871B2

(12) United States Patent
Davidson

(10) Patent No.: US 10,612,871 B2
(45) Date of Patent: Apr. 7, 2020

(54) DRUM AMMUNITION MAGAZINE FOR RIMMED CARTRIDGES

(71) Applicant: Michael J. Davidson, New Carlisle, OH (US)

(72) Inventor: Michael J. Davidson, New Carlisle, OH (US)

( * ) Notice: Subject to any disclaimer, the term of this patent is extended or adjusted under 35 U.S.C. 154(b) by 0 days.

(21) Appl. No.: 16/230,092

(22) Filed: Dec. 21, 2018

(65) Prior Publication Data

US 2019/0219349 A1 Jul. 18, 2019

Related U.S. Application Data

(60) Provisional application No. 62/609,362, filed on Dec. 22, 2017.

(51) Int. Cl.
*F41A 9/75* (2006.01)
*F41A 9/70* (2006.01)

(52) U.S. Cl.
CPC .. *F41A 9/75* (2013.01); *F41A 9/70* (2013.01)

(58) Field of Classification Search
CPC ..... F41A 9/73; F41A 9/74; F41A 9/75
USPC ..... 89/33.02; 42/19
See application file for complete search history.

(56) References Cited

U.S. PATENT DOCUMENTS

| | | | | | |
|---|---|---|---|---|---|
| 2,131,412 | A * | 9/1938 | Östman | F41A 9/73 | 42/49.01 |
| 2,321,720 | A | 6/1943 | Whittaker | | |
| 3,239,959 | A | 3/1966 | Serried, II | | |
| 3,800,658 | A * | 4/1974 | Hougland | F41A 9/74 | 89/33.02 |
| 4,384,508 | A | 5/1983 | Sullivan et al. | | |
| 4,487,103 | A | 12/1984 | Atchisson | | |
| 4,658,700 | A * | 4/1987 | Sullivan | F41A 9/73 | 89/33.02 |
| 4,745,842 | A | 5/1988 | Shou-Fu | | |
| 8,037,800 | B2 | 10/2011 | Snow | | |
| 8,448,364 | B2 | 5/2013 | Davidson | | |
| 2007/0107592 | A1* | 5/2007 | Snow | F41A 9/68 | 89/33.02 |
| 2011/0078937 | A1* | 4/2011 | Rich | F41A 9/73 | 42/49.01 |

* cited by examiner

*Primary Examiner* — Bret Hayes
(74) *Attorney, Agent, or Firm* — Wood Herron & Evans LLP

(57) ABSTRACT

Provided is a detachable drum ammunition magazine for rimmed cartridges having a housing with a neck portion configured for detachable attachment to a firearm. A first sprocket in the housing has a first axis of rotation. A second sprocket within the first sprocket has an axis of rotation concentric with the first axis of rotation. The first sprocket has a gap through which cartridges are pushed to the neck portion and a hinged follower is on the second sprocket.

6 Claims, 10 Drawing Sheets

DRUM AMMUNITION MAGAZINE FOR RIMMED CARTRIDGES

CROSS-REFERENCE TO RELATED APPLICATIONS

This application claims priority to U.S. Provisional Patent Application No. 62/609,362, filed Dec. 22, 2017, and incorporates the same herein by reference.

TECHNICAL FIELD

This invention relates to a firearm ammunition feeding device. More particularly, it relates an increased capacity drum magazine for rimmed cartridges.

BACKGROUND

Firearm ammunition feeding devices typically may be categorized as one that "pushes" cartridges, one that "pulls" cartridges, or one that operates with a combination of pulling and pushing cartridges. In the "push" category, are ammunition magazines with a spring-biased follower behind a row of cartridges held in the magazine and delivered for chambering by the firearm. For rimless cartridges, the number of rounds that can be fed this way is relatively unlimited. In contrast, only a limited number of rounds of rimmed cartridges (usually .22 or .17 caliber rimfire or shotgun shells) can be magazine-fed this way because of the enlarged rim diameter relative to the body of the cartridge and because they must be fed in a way that the rims do not block feeding of an adjacent cartridge.

A "pull" type ammunition feeding device typically includes belt-fed mechanisms or a rotary magazine in which cartridges are engaged and moved by sprocket teeth. Some ammunition feeding mechanisms use a combination of "pull" and "push," in which cartridges are conveyed by a belt or a sprocket until reaching a point at which a limited number of rounds are "pushed" into position to be chambered.

Detachable ammunition magazines generally are either a box or a drum. To increase the capacity of a box magazine, it must be extended in length and/or hold cartridges in multiple rows (such as a "double-stack"). For rimmed cartridges, this presents certain challenges, since they are generally "pushed" by a follower in a box magazine. I addressed these problems for rimmed shotgun cartridges in my prior U.S. Pat. No. 8,448,364 issued May 28, 2013. To increase the capacity of a drum magazine, it must be made a larger diameter or must hold cartridges in multiple spiral or concentric rows. Drum magazines for rimmed shotgun shells have been made with a single row of cartridges held in a sprocket that "pulls" the shells, except for about two that are "pushed" into the short neck to the mouth of the magazine that attaches to the firearm. For example, see U.S. Pat. No. 4,487,103 issued Dec. 11, 1984. Single-row drum magazines for rimmed shotgun shells have been made in different diameters to hold 10, 12, 20, and even 25 rounds. Single-row rotary magazines have been made for rimfire cartridges, such as is shown in U.S. Pat. No. 3,239,959 issued Mar. 15, 1966.

Higher capacity drum magazines for rimless cartridges have been made with multiple rows carried in a spiral path, such as that shown in U.S. Pat. No. 4,745,842 issued May 24, 1988. They have also been made with multiple concentric rows handled by multiple concentric sprockets, such as those shown in U.S. Pat. No. 2,321,720 issued Jun. 15, 1943, 4,384,508 issued May 24, 1983, and U.S. Pat. No. 8,037,800 issued Oct. 18, 2011. The contents of the above-referenced patents are fully incorporated herein by reference. In these concentric designs, the rimless cartridges are fed first from an outer sprocket. Then, the outer sprocket stops rotating while a rotating inner sprocket feeds cartridges through a passageway in the outer sprocket. Such a "pass-through" design requires the cartridges of either inner sprocket to be "pushed" a longer distance than those fed from the outer sprocket. This is not a problem for rimless rifle and pistol cartridges. However, due to multiple challenges and problems associated with "pushing" rimmed cartridges and transitioning them from one handling system to another, there has not been a drum magazine for rimmed cartridges held in multiple concentric rows where they pass through an outer sprocket from an inner sprocket.

SUMMARY OF THE INVENTION

The present invention provides a drum ammunition magazine that holds rimmed cartridges (such as shotgun shells) in multiple substantially concentric rows and feeds those from and inner sprocket through and outer sprocket to the neck of the magazine to its mouth for delivery in a position for consistent and reliable chambering by the firearm.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
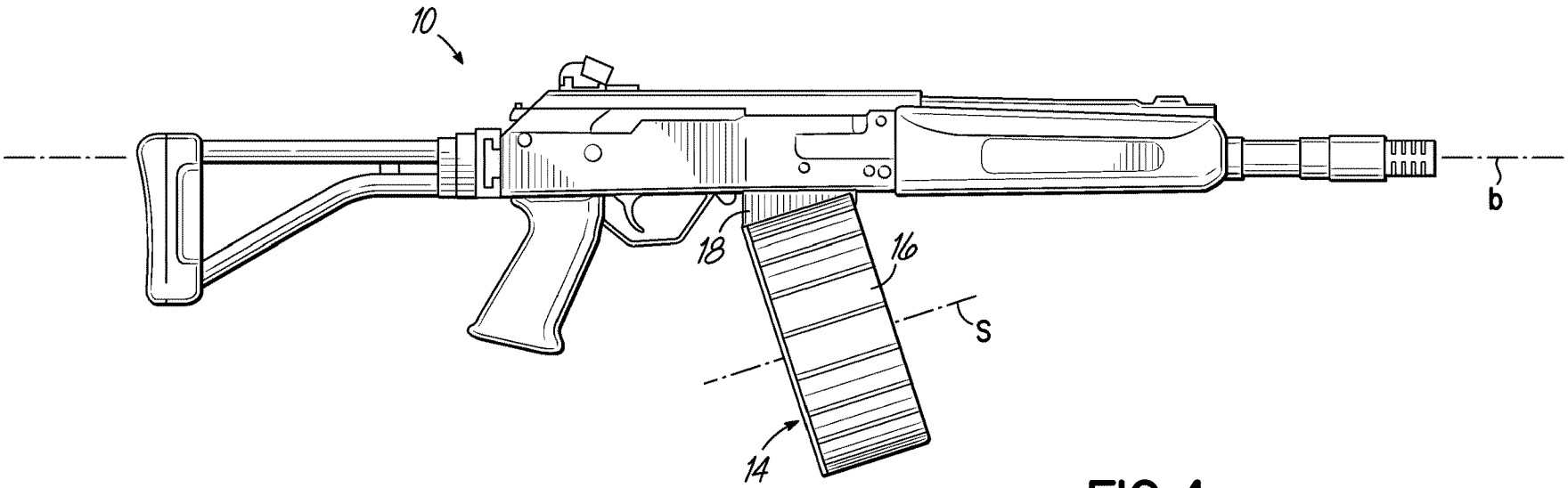
FIG. 1 is a side view of an auto-loading shotgun with a removable drum ammunition magazine according to an embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
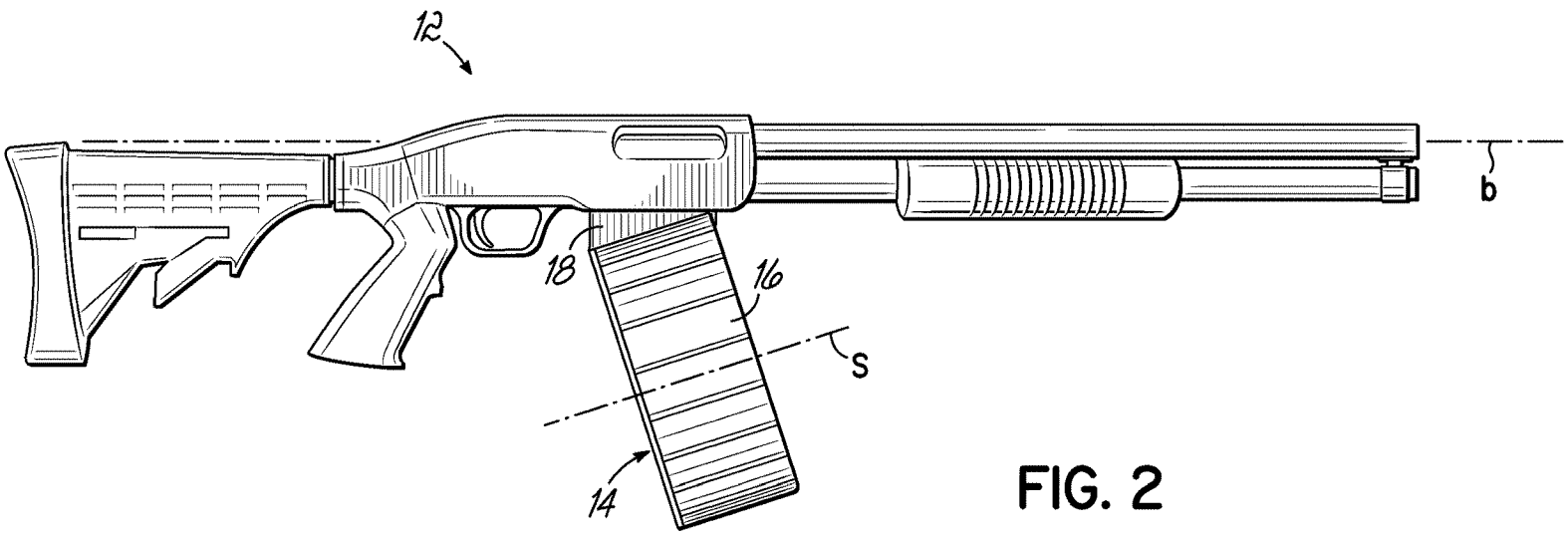
FIG. 2 is a side view of a pump-action shotgun with a removable drum ammunition magazine according to an embodiment of the present invention.

Referring now to the various drawing figures, and first to FIGS. 1 and 2, therein is shown an auto-loading shotgun 10 (FIG. 1) and a pump-action shotgun 12 (FIG. 2), each with a detachable drum ammunition magazine 14 according to one embodiment of the present invention.

Figure 3:
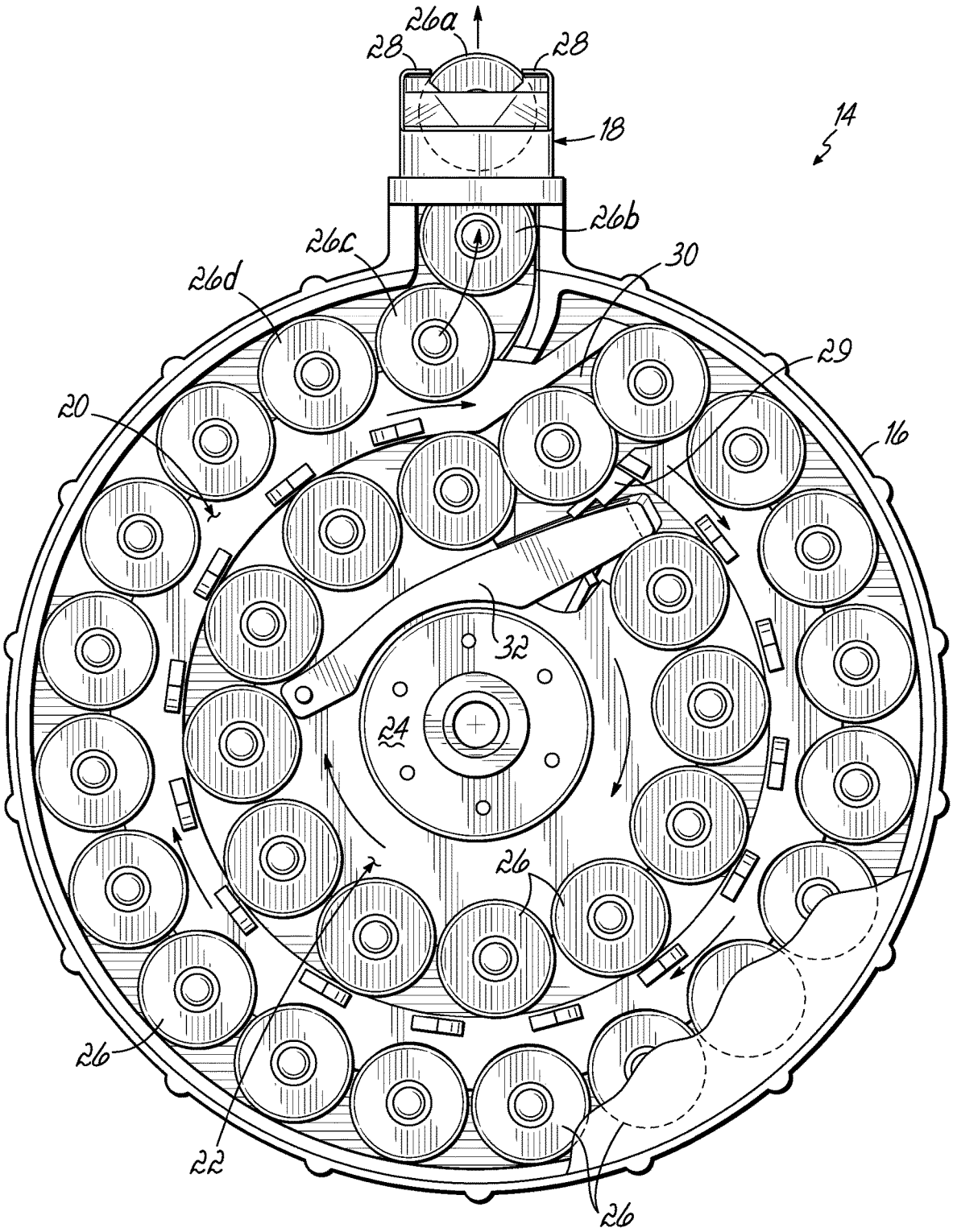
FIG. 3 shows a rear view of a drum ammunition magazine for 12-gauge shotgun shells according to an embodiment of the present invention holding 33 rounds with the rear cover removed.

Referring now to FIG. 3, therein is shown a drum magazine 14 for 12-gauge shotgun shells according to one embodiment of the present invention. The illustrated embodiment is adapted to hold and reliably feed 33 rounds. The drum magazine 14 includes an outer, generally cylindrical housing 16 and a neck portion 18 that is adapted to be detachably engaged with a firearm 10, 12 according to one of many well-known mechanisms. Within the housing 16 are an outer sprocket 20 and a substantially concentric inner sprocket 22. At the axial center of the inner sprocket 22 is a hub 24 which can house a torsion spring (not shown) or other drive mechanism to rotate the sprockets 20, 22 and advance the position of each cartridge 26 as they are used. The cartridges 26 are delivered through the neck portion 18 and held by feed lips 28 in a correct orientation to be stripped from the magazine 14 as a firearm bolt moves forward to chamber a cartridge 26 according to a mechanical sequence well known to persons of ordinary skill in this field.

FIG. 3 shows the drum magazine 14 fully loaded. A first cartridge 26*a* and second cartridge 26*b* are in the neck portion 18 and are being "pushed" by subsequent cartridges 26 held in the outer sprocket 20 which is being driven in a clockwise direction by a spring drive mechanism. When the first cartridge 26*a* is removed, both sprockets 20, 22 will rotate clockwise one position, causing another cartridge 26 held by the outer sprocket 20 to advance into the neck portion 18.

Figure 4:
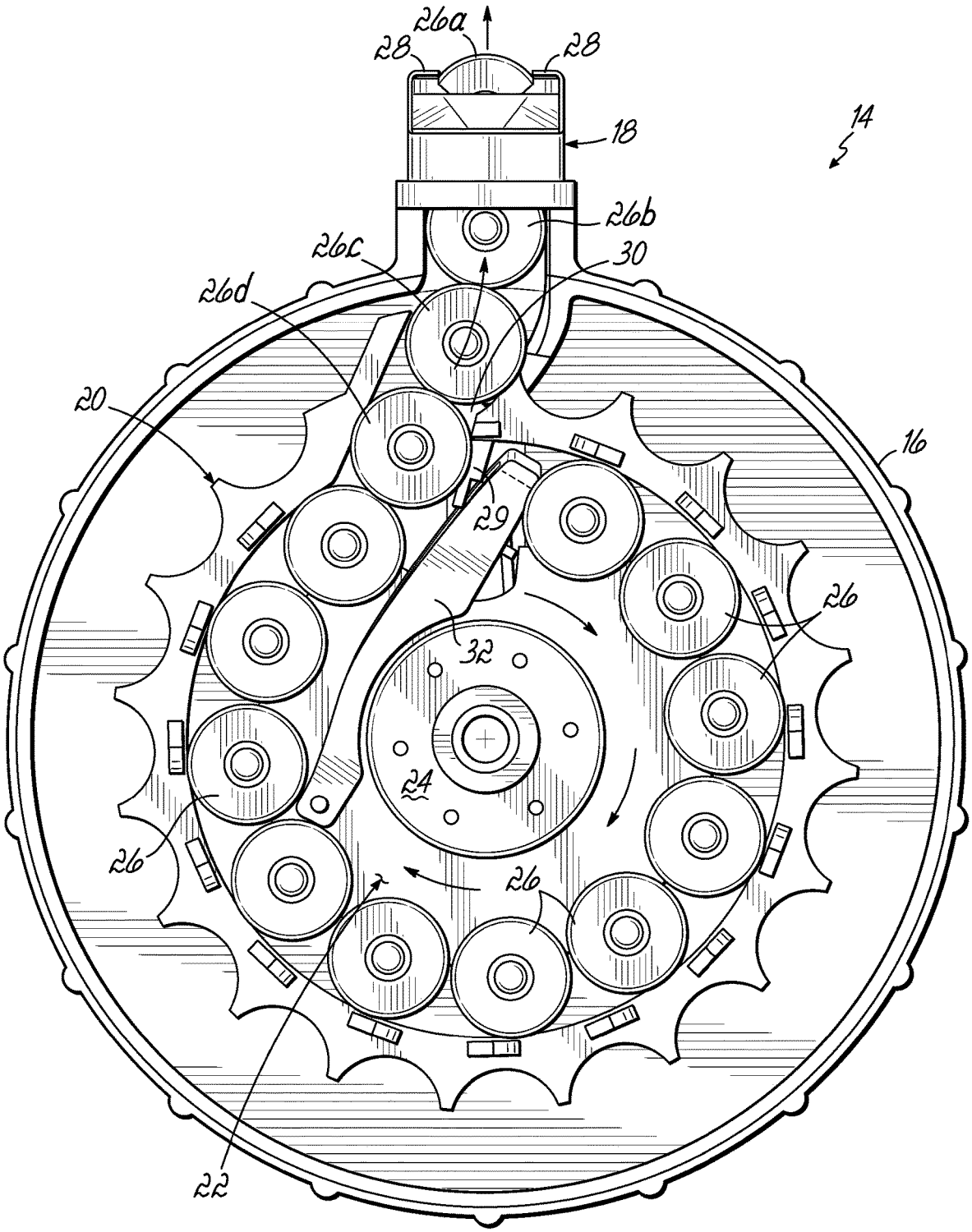
FIG. 4 is a similar view showing only the inner sprocket loaded with cartridges.
Figure 5:
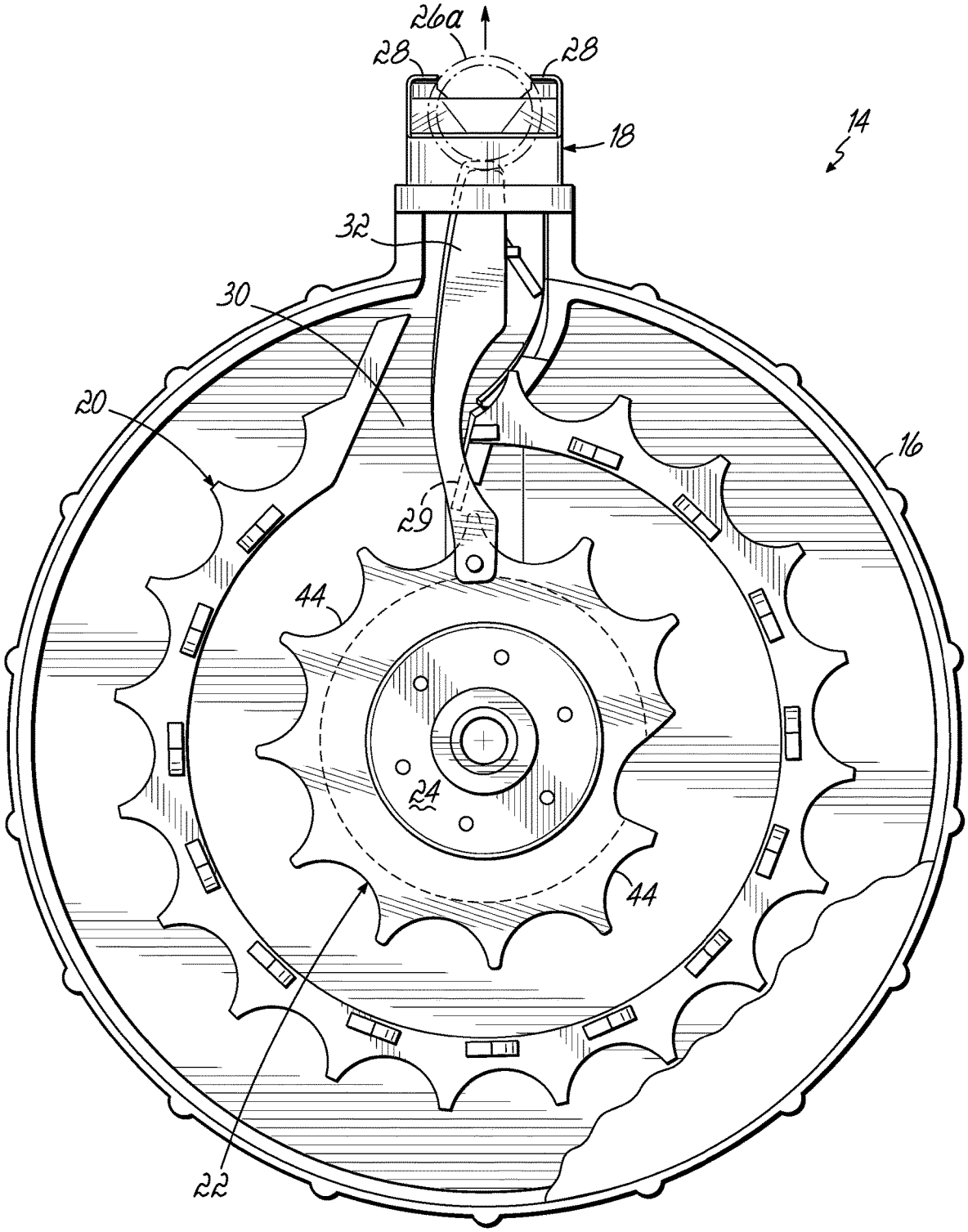
FIG. 5 shows a similar view empty of cartridges.
Figure 6:
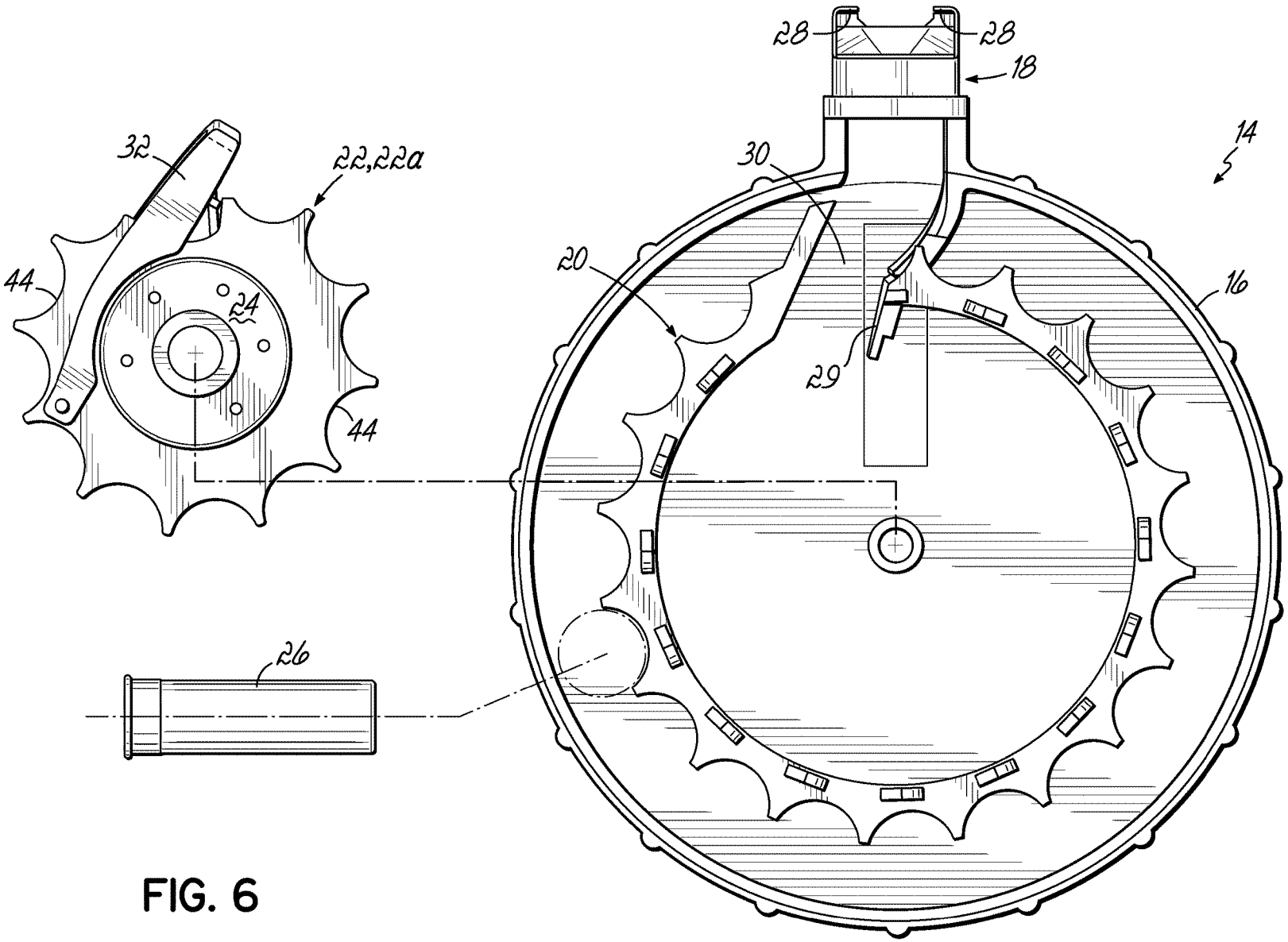
FIG. 6 is a pictorial view showing the inner sprocket removed from the assembly.

Referring now to FIG. 4, when all cartridges 26 from the outer sprocket 20 have been advanced and used, the outer sprocket 20 engages a stop mechanism to prevent further rotation. Cartridges 26 held by the inner sprocket 22 continue to advance and are guided by a feed ramp 29 to pass through a gap 30 in the outer sprocket 20, allowing the cartridges 26 to be fed into the neck portion 18. In this state, four cartridges 26 are not engaged in teeth of either sprocket 20, 22 and are being "pushed" by succeeding cartridges 26 through the gap 30 and into the neck portion 18. As shown in FIG. 5, once all cartridges 26 are lifted from engagement with teeth of the inner sprocket 22, a hinged follower 32 will push the last cartridge 26 into position for chambering. Other types of follower means may be used, such as linked-together dummy rounds or other inert body or bodies.

A discussion of prior detachable magazines for shotguns will provide context in which to appreciate the present invention. The design of each firearm that uses a detachable ammunition magazine will require a cartridge to be presented at a particular orientation relative to the axis of the barrel bore/chamber and bolt in order to be engaged by a forwardly moving bolt and reliably moved into the chamber. Typically, this requires that a longitudinal axis of the cartridge be at least parallel to the barrel axis or, typically, with the forward end of the cartridge as least slightly elevated relative to the barrel axis. When rimmed cartridges are being "pushed" into position at the mouth of a detachable magazine, because the forward end of the cartridge has a smaller diameter than the rim at the rear end of the cartridge, some accommodation must be made to compensate for this difference and deliver cartridges at a proper orientation.

In the previously mentioned U.S. Pat. No. 4,487,103, the sprocket's axis of rotation is substantially parallel to the bore axis of the barrel. In order to deliver rimmed shotgun cartridges oriented with a longitudinal axis parallel to or forwardly inclined above that of the barrel, the forward and rear sprocket teeth are slightly rotationally misaligned so that each cartridge is held in a circumferentially skewed position with the forward end arriving for delivery into the neck of the magazine slightly ahead of the rearward or head end. Accordingly, when the cartridges disengage from the sprocket teeth and are "pushed" into position, the skewed orientation of the second-in-line (or next-in-line) cartridge will cause the first-in-line cartridge to be presented at a proper angle.

In other known drum ammunition magazines for rimmed shotgun cartridges, the cartridges are held with their longitudinal axes substantially parallel to the axis of rotation of the sprocket. This is illustrated with general reference again to FIGS. 1 and 2, where the barrel bore axis is labeled b and the rotational axis of the sprocket in the drum magazine 14 is labeled s. The sprocket's axis of rotation s is angled (forwardly inclined) relative to the bore axis b of the barrel such that the forward end of each cartridge is elevated when presented at the feed lips. In this manner, the difference in end diameters is compensated by the angle at which cartridges are carried in the single sprocket before being "pushed" into the neck of the magazine in prior designs.

These two ways of compensating are adequate in a drum magazine where cartridges are carried in a single row by a sprocket such that the number of cartridges being "pushed" after leaving engagement with the sprocket is fixed and travels a fixed distance into the neck of the magazine. These ways will fail, however, if a drum magazine includes a second row of cartridges held and driven by a second, concentric sprocket. As previously described, the cartridges delivered from the inner sprocket must traverse a greater distance and a greater number of consecutive rimmed cartridges are "pushed" from the inner sprocket, substantially radially through the outer sprocket, and into the neck of the magazine.

Figure 10:
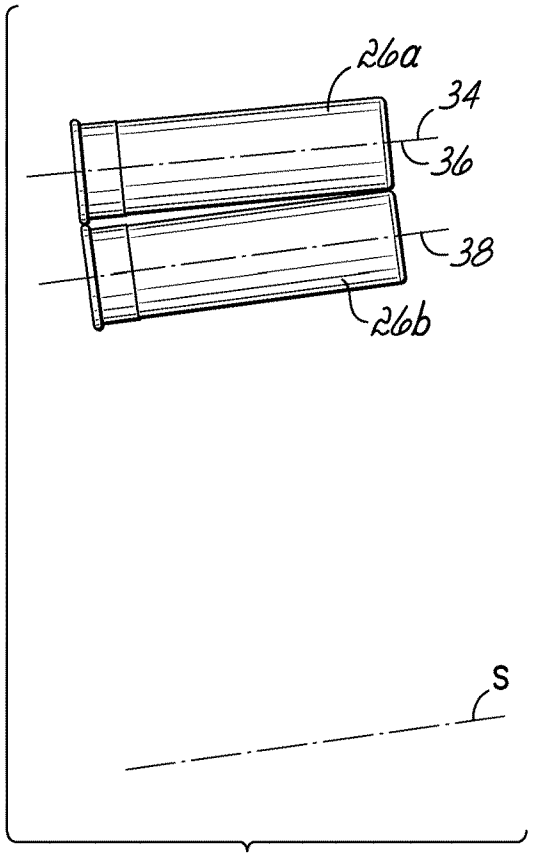
FIG. 10 is a schematic representation of the relative angle of the longitudinal axis of two rimmed shotgun cartridges.

Referring now to FIG. 10, therein is shown a schematic representation of a first-in-line rimmed cartridge 26*a* having a longitudinal axis 34 that is the same as a delivery axis 36 at which the cartridge is correctly positioned for delivery from the mouth of a magazine. This delivery axis 36 may be, for example, parallel to or forwardly elevated above the bore axis b of a firearm barrel. A second-in-line cartridge 26*b* is shown having a longitudinal axis 38 that is skewed relative to the axis 36 of the first cartridge 26*a*, with the forward, smaller diameter end elevated relative to the rimmed head end of the cartridge 26*b*. This axis 38 may be parallel with the axis of rotation of the sprocket(s) s. As previously described, the angular difference between the longitudinal axes (34, 36 and 38, s) compensate for the difference in diameter between the respective ends of the cartridges 26*a*, 26*b*. Alternatively, this compensation may be accomplished by skewing the longitudinal axis of each cartridge 26 held in an outer sprocket (20), as previously described.

Figure 11:
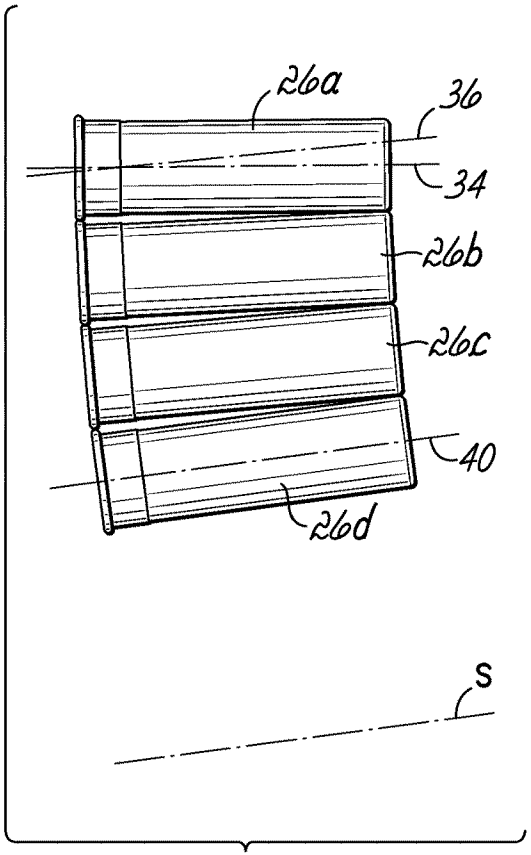
FIG. 11 is a schematic representation showing a similar relationship with respect to four adjacent rimmed shotgun cartridges.

As schematically depicted in FIG. 11, when cartridges are being "pushed" from an inner sprocket (22) a greater radial distance, the difference in diameter between the forward and rear end of the cartridges 26*a*, 26*b*, 26*c*, 26*d* may be compounded four-fold. In this schematic representation, the longitudinal axis 32 of the fourth-in-line cartridge 26*d* (being delivered from an inner sprocket 22) is depicted substantially parallel to the rotational axis s of the sprockets. Relative to the delivery axis 36, the first-in-line cartridge 26*a* in FIG. 11 has a longitudinal axis 34 that is forwardly declined. Thus, skewing the axis of rotation s of the sprockets relative to the delivery axis 36 (or bore axis b), sufficient to compensate when cartridges 26 are fed from a single sprocket 20, is not alone sufficient to compensate when additional cartridges are fed from a second, concentric inner sprocket 22.

Figure 12:
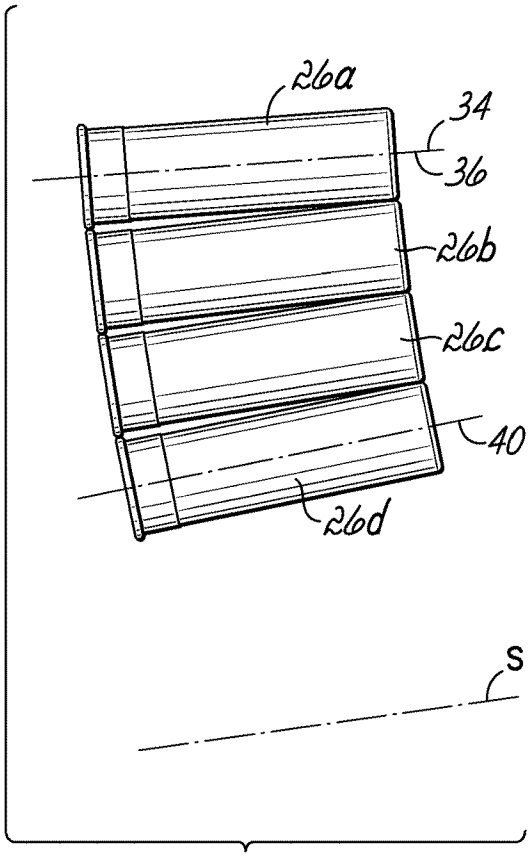
FIG. 12 is a similar schematic representation showing a corrected angle according to an embodiment of the present invention.

Referring now to FIG. 12, according to an aspect of the present invention, the first in line cartridge 26*a* can be presented with its axis 34 at the desired delivery axis 36 when the longitudinal axis 40 of the fourth-in-line cartridge 26*d* is skewed to a greater degree than the axis of rotation s of the sprockets. However, it is not practical (if possible) to use outer and inner sprockets 20, 22 with different axes of rotation. The present invention provides a drum magazine 14 for rimmed shotgun cartridges 26 carried by concentric, coaxial outer and inner sprockets 20, 22 that separately addresses angular compensation for the cartridges 26 being fed from the outer sprocket 20 and "pushed" a first shorter number/distance and those being fed from the inner sprocket 22 and "pushed," through a gap 30 in the outer sprocket, a second, greater number/distance.

This compensation for proper delivery orientation can be accomplished in one of multiple ways, according to different embodiments of the present invention, none of which have been appreciated or realized in the prior art. First, as previously described, the housing 16 and axis of rotation s for both the inner and outer sprockets 20, 22 may be skewed relative to the delivery axis 36 of a first-in-line cartridge 26*a*. When cartridges 26 carried in the outer sprocket 20 are in an axially parallel relationship, the delivery angle from the outer sprocket 20 can be fully compensated, as previously recognized and described with respect to the schematic representation in FIG. 10, by skewing the axis of rotation s to the delivery axis 36. However, as schematically represented in FIG. 10, further compensation must be provided for the cartridges 26 being delivered from the inner sprocket 22.

Figure 7:
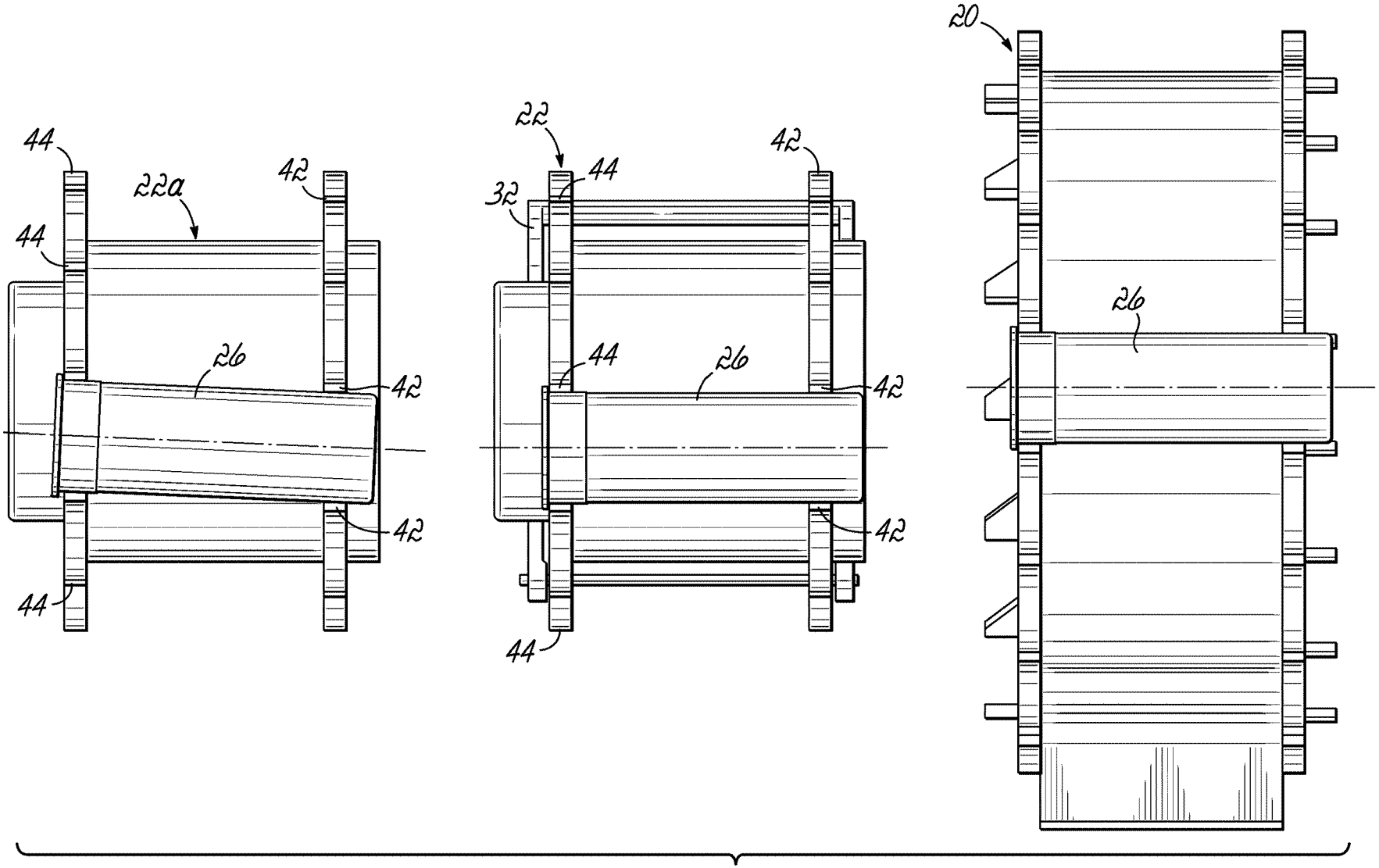
FIG. 7 is a top pictorial view of an outer sprocket and alternate embodiments of an inner sprocket.
Figure 8:
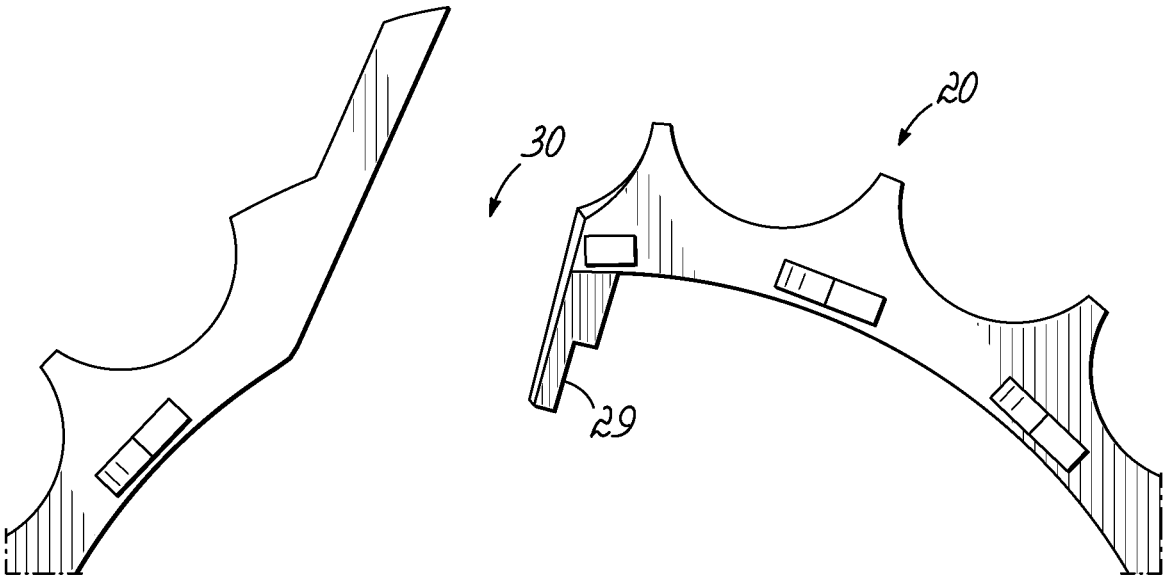
FIG. 8 is a close-up view of an example transition ramp on the inner edge of an outer sprocket.
Figure 9:
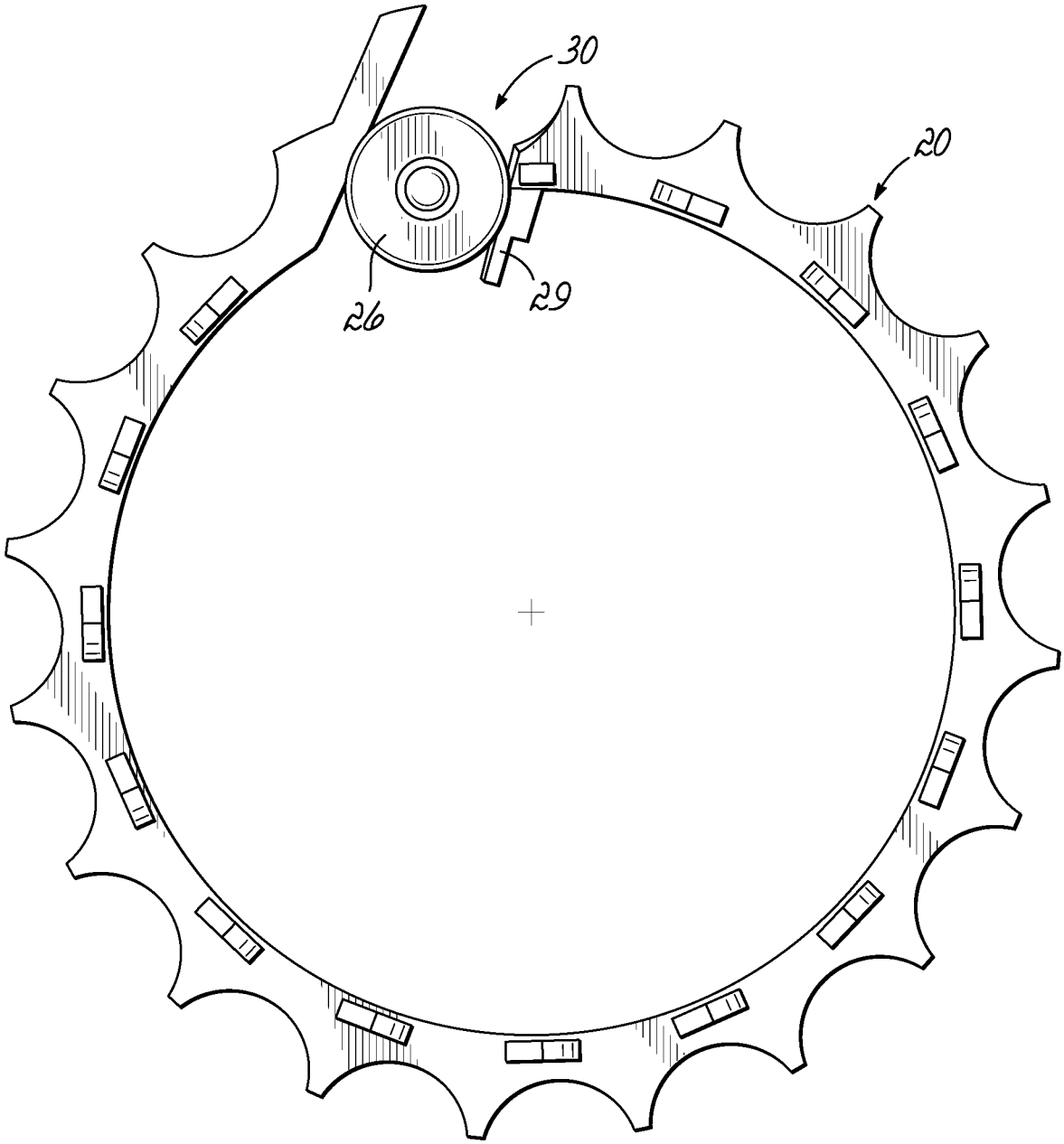
FIG. 9 is a similar view showing a shotgun cartridge positioned thereon.
Figure 13:
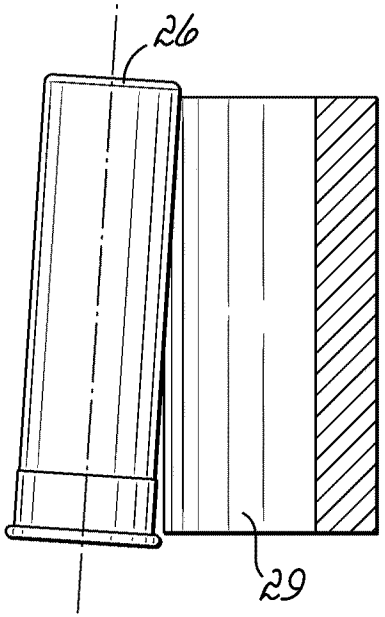
FIG. 13 is a top plan view showing a circumferentially skewed cartridge engaging a portion of a feed ramp.

Referring now also to FIGS. 7 and 13, according to one embodiment of the present invention, forward and rear teeth 42, 44 of the inner sprocket 22*a* may be circumferentially skewed so that the forward end of each cartridge 26 carried by the inner sprocket 22*a* is sufficiently circumferentially advanced such that the forward end of the cartridge 26 engages the feed ramp 29 before the rear end and is fed ahead of the rear end. When lifted from the sprocket teeth 42, 44 by the ramp 29 and "pushed" through the gap 30 of the outer sprocket 20 and the neck portion 18, the first-in-line cartridge 26*a* will be properly oriented, as depicted schematically in FIG. 10 and pictorially illustrated in FIG. 9.

According to a second alternate embodiment (not shown), the inner sprocket 22 may be configured such that the teeth holding the forward end of each cartridge 26 has a radius greater than that of the teeth holding the rear or rimmed head end of the cartridge 26. Accordingly, the longitudinal axis of each cartridge 26 held by the inner sprocket 22 would be outwardly skewed at its forward end relative to the axis of rotation s for the sprockets 20, 22 to provide a similar angular compensation pictorially depicted in FIG. 9 and schematically depicted in FIG. 10.

Figure 15:
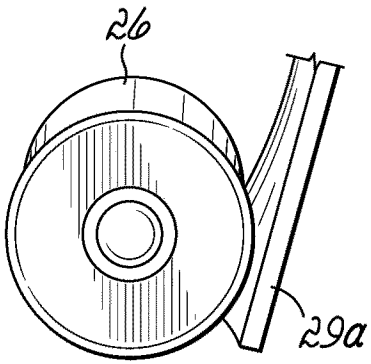
FIG. 15 is a rear view showing the engagement of FIG. 14.
Figure 14:
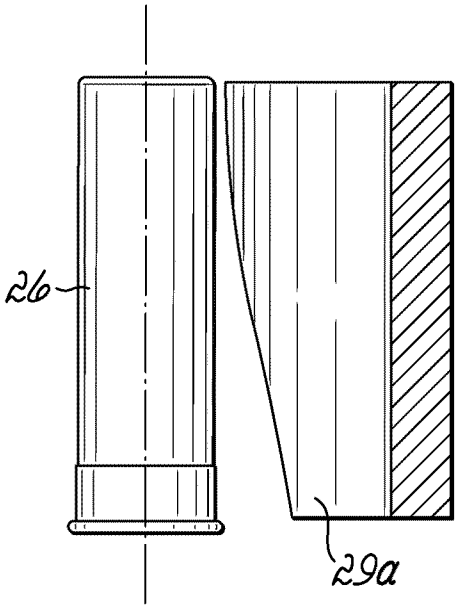
FIG. 14 is a top plan view showing a cartridge engaging a portion of an asymmetric feed ramp.

According to a third alternate embodiment, the cartridges 20 in both the outer sprocket 20 and inner sprocket 22 may all be held with longitudinal axes substantially parallel to each other and to that of the sprockets' axis of rotation s (although still skewed relative to the delivery axis 36). As depicted in FIGS. 14 and 15, in this embodiment, an asymmetric feed ramp 29*a* extending inwardly from the outer sprocket 20 to guide cartridges 26 through the gap 30 may engage the forward end of each cartridge 26 and begin guiding it into the gap 24 in advance of engagement with the rearward, rimmed end.

In other embodiments, combinations of the means described above may be used to collectively compensate for the angular differential between cartridges 26 fed from the outer sprocket 20 and those pushed a greater distance/number from the inner sprocket 22. If enlarged to include three or more concentric sprockets, a combination of angle compensation means may be used.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A detachable drum ammunition magazine for rimmed cartridges, comprising:

a plurality of rimmed cartridges having a casing with a wall, a rimmed end that is larger in diameter than the casing wall, and an opposite end;

a housing having a neck portion configured for detachable attachment to a firearm;

a first cartridge-holding sprocket in the housing having a first axis of rotation;

a second cartridge-holding sprocket within the first sprocket and having an axis of rotation concentric with the first axis of rotation;

the first sprocket having a gap through which cartridges held by the second sprocket are pushed to the neck portion; and a hinged follower on the second sprocket, wherein both sprockets rotate until all cartridges held by the first sprocket have been pushed into the neck portion, then the first sprocket stops with the gap in alignment with the neck portion and stays stopped while the second sprocket rotates until all cartridges held by the second sprocket have been pushed into the neck portion, and wherein the first and second sprockets hold the cartridges substantially parallel to each other and cartridges held by the second sprocket engage an offset ramp at the gap configured to advance each cartridge's opposite end ahead of the rimmed end as the cartridge encounters the ramp.

2. The drum magazine of claim 1, wherein the sprockets are spring driven to rotate.

3. The drum magazine of claim 1, wherein the sprockets have teeth that at least partially engage cartridges, the first sprocket holding cartridges between teeth and a wall of the housing, and the second sprocket holding cartridges between the teeth and the first sprocket.

4. The drum magazine of claim 1, wherein the follower extends through the gap to push cartridges into the neck portion.

5. The drum magazine of claim 1, wherein the follower is offset to advance the cartridge opposite end ahead of the rimmed end.

6. A detachable drum ammunition magazine for rimmed cartridges, comprising:

a plurality of rimmed cartridges having a casing with a wall, a rimmed end that is larger in diameter than the casing wall, and an opposite end;

a housing having a neck portion configured for detachable attachment to a firearm;

a first cartridge-holding sprocket in the housing having a first axis of rotation;

a second cartridge-holding sprocket within the first sprocket and having an axis of rotation concentric with the first axis of rotation;

the first sprocket having a gap through which cartridges held by the second sprocket are pushed to the neck portion; and a hinged follower on the second sprocket, wherein both sprockets rotate until all cartridges held by the first sprocket have been pushed into the neck portion, then the first sprocket stops with the gap in alignment with the neck portion and stays stopped while the second sprocket rotates until all cartridges held by the second sprocket have been pushed into the neck portion, and wherein the second sprocket holds cartridges in a skewed position with the opposite end rotationally advanced ahead of the rimmed end.

* * * * *